US007082908B2

(12) United States Patent
Matsutani et al.

(10) Patent No.: US 7,082,908 B2
(45) Date of Patent: Aug. 1, 2006

(54) COOLING STRUCTURE OF CYLINDER BLOCK

(75) Inventors: Takashi Matsutani, Toyota (JP); Takanori Nakada, Toyota (JP); Yoshikazu Shinpo, Nisshin (JP); Makoto Hatano, Obu (JP); Takashi Kubota, Obu (JP)

(73) Assignees: Toyota Jidosha Kabushiki Kaisha, Toyota (JP); Aisan Kogyo Kabishiki Kaisha, Obu (JP)

( * ) Notice: Subject to any disclaimer, the term of this patent is extended or adjusted under 35 U.S.C. 154(b) by 0 days.

(21) Appl. No.: 11/081,732

(22) Filed: Mar. 17, 2005

(65) Prior Publication Data

US 2005/0211196 A1 Sep. 29, 2005

(30) Foreign Application Priority Data

Mar. 26, 2004 (JP) ..... 2004-093029

(51) Int. Cl.
*F02F 1/10* (2006.01)

(52) U.S. Cl. ..... 123/41.72; 123/41.15; 123/41.74; 123/41.81; 123/198 D

(58) Field of Classification Search ..... 123/41.72, 123/41.15, 41.74, 41.79, 41.81, 41.83, 198 D
See application file for complete search history.

(56) References Cited

U.S. PATENT DOCUMENTS 4,782,891 A * 11/1988 Cheadle et al. ..... 165/134.1

FOREIGN PATENT DOCUMENTS

JP 04-119330 10/1992
JP 2002-030989 1/2002

* cited by examiner

*Primary Examiner*—Henry C. Yuen
*Assistant Examiner*—Katrina Harris
(74) *Attorney, Agent, or Firm*—Kenyon & Kenyon LLP

(57) ABSTRACT

A cooling structure of a cylinder block includes a water jacket portion which is provided so as to surround an entire outer periphery of a bore wall; and a water jacket spacer which is inserted in the water jacket portion. A foreign matter collecting mechanism which collects foreign matter is provided in a bottom portion of the water jacket portion.

8 Claims, 6 Drawing Sheets

COOLING STRUCTURE OF CYLINDER BLOCK

INCORPORATION BY REFERENCE

The disclosure of Japanese Patent Application No. 2004-093029 filed on Mar. 26, 2004, including the specification, drawings and abstract is incorporated herein by reference in its entirety.

BACKGROUND OF THE INVENTION

1. Field of the Invention

The invention relates to a cooling structure of a cylinder block, and more particularly to a cooling structure of a cylinder block in which foreign matter can be captured.

2. Description of the Related Art

A cooling structure of a cylinder block is disclosed, for example, in Japanese Patent Laid-Open Publication No. 2002-30989.

In the cooling structure of a cylinder block disclosed in the Japanese Patent Laid-Open Publication No. 2002-30989, the temperature of a bore wall is made uniform by providing a water jacket spacer inside a water jacket portion of a cylinder block of an internal combustion engine. However, when the water jacket spacer is installed, a processing burr on an upper surface of the cylinder block may be cut off and may fall into the water jacket portion. The burr that has fallen into the water jacket may damage a mechanical seal of a water pump, which leads to water leakage, and a decrease in reliability.

SUMMARY OF THE INVENTION

The invention is made in order to solve the aforementioned problem. It is an object of the invention to provide a highly reliable cooling structure of a cylinder block.

An aspect of the invention relates to a cooling structure of a cylinder block including a water jacket portion which is provided so as to surround an entire outer periphery of a bore wall; and a water jacket spacer which is inserted in the water jacket portion. The cooling structure of a cylinder further includes a foreign matter collecting mechanism which is provided in a bottom portion of the water jacket portion, and which collects foreign matter.

In the cooling structure of a cylinder block that is thus configured, since the foreign matter collecting mechanism for collecting foreign matter is provided in the bottom portion of the water jacket portion, foreign matter in the bottom portion of the water jacket portion can be collected and retained by the foreign matter collecting mechanism. As a result, foreign matter is prevented from entering a water pump. Thus, it is possible to provide the highly reliable cooling structure of a cylinder block.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
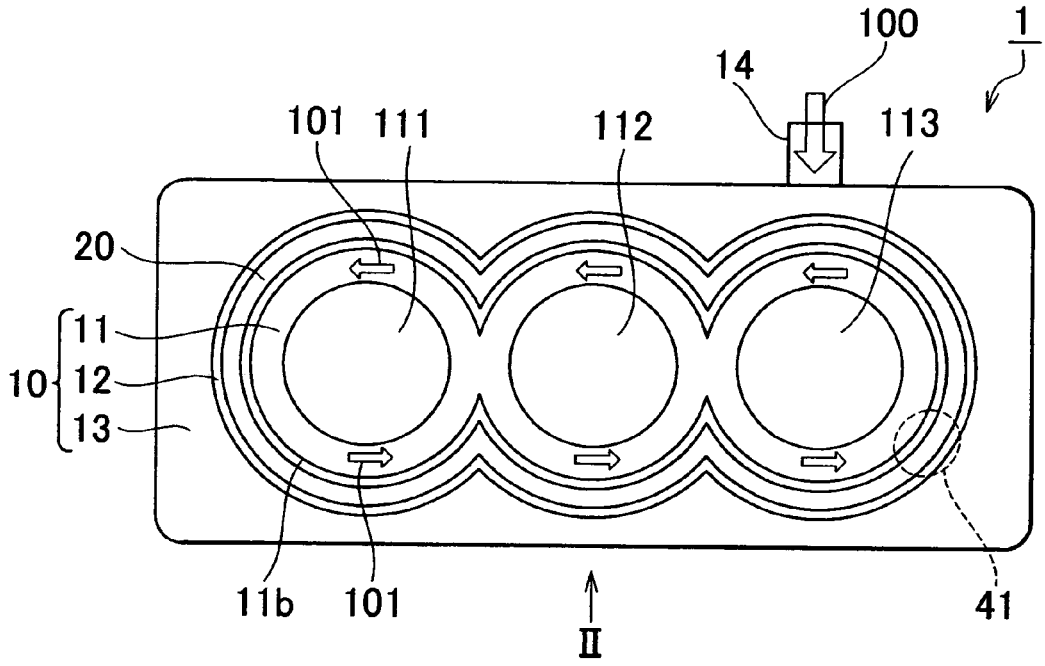
FIG. 1 is a plan view showing a cooling structure of a cylinder block according to a first embodiment of the invention.

Hereinafter, exemplary embodiments of the invention will be described with reference to the accompanying drawings. In the following embodiments, the same portions or equivalent portions are denoted by the same reference numerals, and duplicate description thereof will be omitted.

FIG. 1 is a plan view showing a cooling structure of a cylinder block according to a first embodiment of the invention. As shown in FIG. 1, in a cooling structure 1 of a cylinder block according to a first embodiment of the invention, a cylinder block 10 is cooled by coolant that is a cooling medium. The cylinder block 10 includes a cylinder liner assembly 11; a water jacket portion 12 which has a groove shape, and which surrounds the cylinder liner assembly 11; and a cylinder block base portion 13 which surrounds the water jacket portion 12.

The cylinder liner assembly 11 includes three bore regions 111, 112, and 113. The bore regions 111, 112, and 113 are surrounded by iron alloy, and the iron alloy is surrounded by aluminum alloy. The cylinder liner assembly 11 is surrounded by the water jacket portion 12 in which the cooling medium flows. The water jacket portion 12 has a concave shape. Also, the water jacket portion 12 has a shape similar to a shape of the cylinder liner assembly 11 so as to surround the cylinder liner assembly 11. The cylinder block base portion 13 is an engine block main body, and is made of aluminum alloy.

A hole 14 which serves as an inlet for the cooling medium is provided in the cylinder block base portion 13. A gasket (not shown) is provided so as to cover the cylinder block base portion 13. A gasket hole 41 which serves as a passage for the cooling medium is provided in the gasket. An engine head is provided on the gasket. A passage which leads to the gasket hole 41 is provided in the engine head. Since the cooling medium flows through the passage, the engine head can be cooled. The water jacket spacer 20 is inserted in the water jacket portion 12. The water jacket spacer 20 is provided between the cylinder liner assembly 11 and the cylinder block base portion 13. The water jacket spacer 20 has a shape similar to a shape obtained by connecting plural cylinders. The water jacket spacer 20 surrounds the three bore regions 111, 112, and 113. For example, the water jacket spacer 20 is made of resin. However, the material used for making the water jacket spacer 20 is not limited to resin. The water jacket spacer 20 may be made of other materials such as metal and nonmetal.

Next, a flow of the cooling medium (coolant) will be described with reference to FIG. 1. The cooling medium supplied from the water pump is supplied to the hole 14 in a direction indicated by an arrow 100. The cooling medium is delivered to the water jacket portion 12 through the cylinder block base portion 13. In the water jacket portion 12, the coolant flows in a region between the water jacket spacer 20 and a bore wall 11*b*, and a region between the water jacket spacer 20 and the cylinder block base portion 13. The coolant flows in a counterclockwise direction as shown an arrow 101. When the coolant contacts the bore wall 11*b*, the coolant absorbs heat of the bore wall 11*b*, thereby cooling the bore wall 11*b* and the cylinder liner assembly 11. Further, when the coolant contacts the cylinder block base portion 13, the coolant cools the cylinder block base portion 13. After the coolant flows in the direction indicated by the arrow 101, the coolant flows toward the engine head through the gasket hole 41.

In FIG. 1, a block U-turn cooling system is employed. In this system, the coolant makes a U-turn, and is discharged to the outside. That is, after the cooling medium cools the cylinder liner assembly 11, the cooling medium flows to the engine head through the gasket hole 41, and cools components in the engine head. Then, the cooling medium flows toward a radiator, and discharges heat to the radiator. Then, the cooling medium is delivered to the hole 14 again by the water pump.

Figure 2:
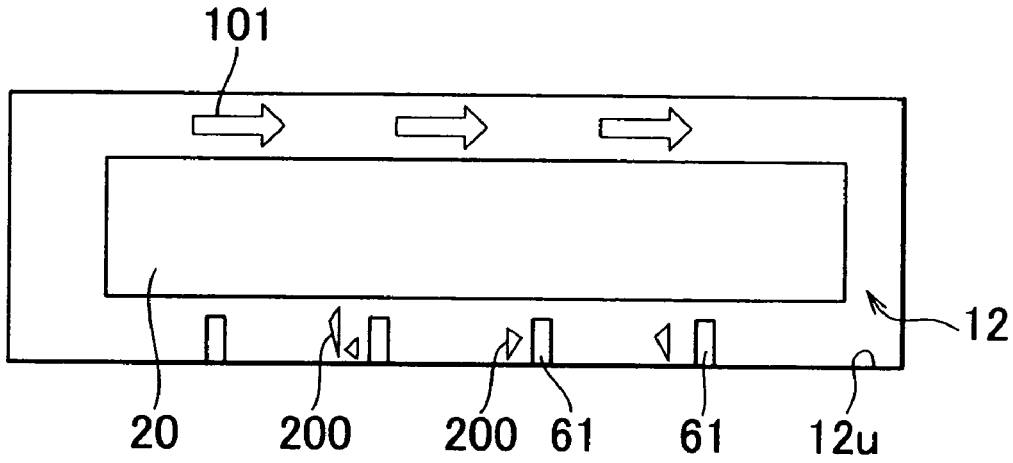
FIG. 2 is a schematic lateral view showing a water jacket portion seen in a direction indicated by an arrow II in FIG. 1.

FIG. 2 is a schematic lateral view showing the water jacket portion seen in a direction indicated by an arrow II in FIG. 1. As shown in FIG. 2, the water jacket portion 12 includes a bottom portion 12*u*. Plural (four) protrusion portions 61 are provided in the bottom portion 12*u*. The protrusion portions 61 serve as resistance to the flow of the coolant indicated by the arrow 101. The protrusion portions 61 stem a flow of foreign matter 200 including a burr or the like, and prevent the foreign matter 200 from flowing to a downstream side, that is, the water pump side.

The cooling structure 1 of a cylinder block 10 includes the water jacket portion 12 which is provided so as to surround an entire outer periphery of the bore wall 11*b*, and the water jacket spacer 20 which is inserted in the water jacket portion 12. The protrusion portions 61 are provided in the bottom portion 12*u* of the water jacket portion 12. The protrusion portions 61 serve as a foreign matter collecting mechanism that collects the foreign matter 200.

In the cooling structure of a cylinder block that is thus configured according to the first embodiment, since the protrusion portions 61 for collecting foreign matter are provided in the bottom portion 12*u* of the water jacket portion 12, it is possible to stem the flow of the foreign matter 200 including the burr or the like, using the protrusion portions 61 provided in the bottom portion 12*u*. As a result, the foreign matter 200 can be prevented from flowing into the water pump. Therefore, a mechanical seal of the water pump can be prevented from being damaged, and further the water pump can be prevented from being locked. Thus, it is possible to provide the highly reliable cooling structure of a cylinder block.

Figure 3:
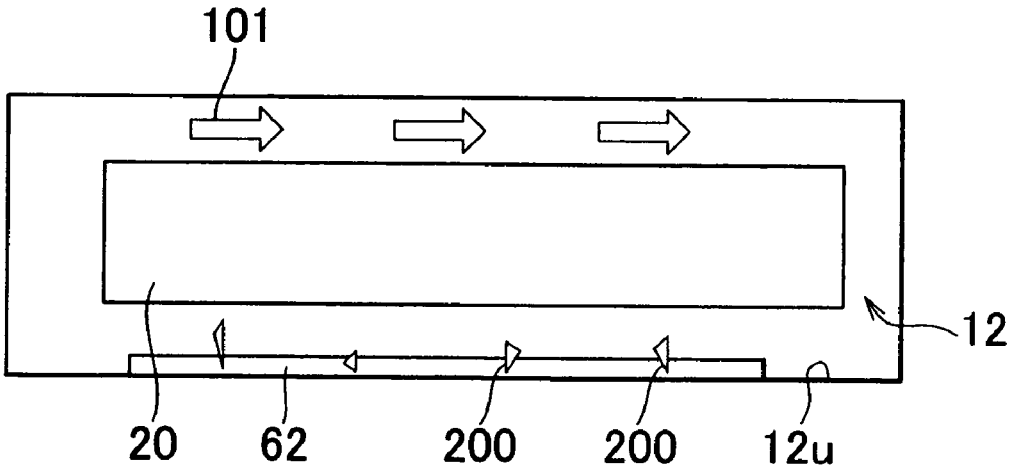
FIG. 3 is a lateral view showing a water jacket portion used in a cooling structure of a cylinder block according to a second embodiment of the invention.

FIG. 3 is a lateral view showing a water jacket portion used in a cooling structure of a cylinder block according to a second embodiment of the invention. As shown in FIG. 3, in the water jacket portion 12 according to the second embodiment of the invention, an adhesive material 62 which serves as the foreign matter collecting mechanism is provided in the bottom portion 12*u*. The adhesive material 62 adheres to the bottom portion 12*u* using adhesive force thereof. The adhesive material 62 is made of, for example, organic matter. The adhesive material 62 adsorbs the foreign matter 200 that mainly includes the burr. The adhesive material 62 may be provided on an upstream side (hole 14 side) or on a downstream side (gasket hole 41 side) in a direction in which the coolant flows, as long as the adhesive material 62 is provided in the bottom portion 12*u* of the water jacket portion 12.

In the cooling structure of a cylinder block that is thus configured according to the second embodiment of the invention, foreign matter can be prevented from being circulated, as well as the cooling structure of a cylinder block according to the first embodiment of the invention. Thus, the cooling structure of a cylinder block according to the second embodiment of the invention is also highly reliable.

Figure 4:
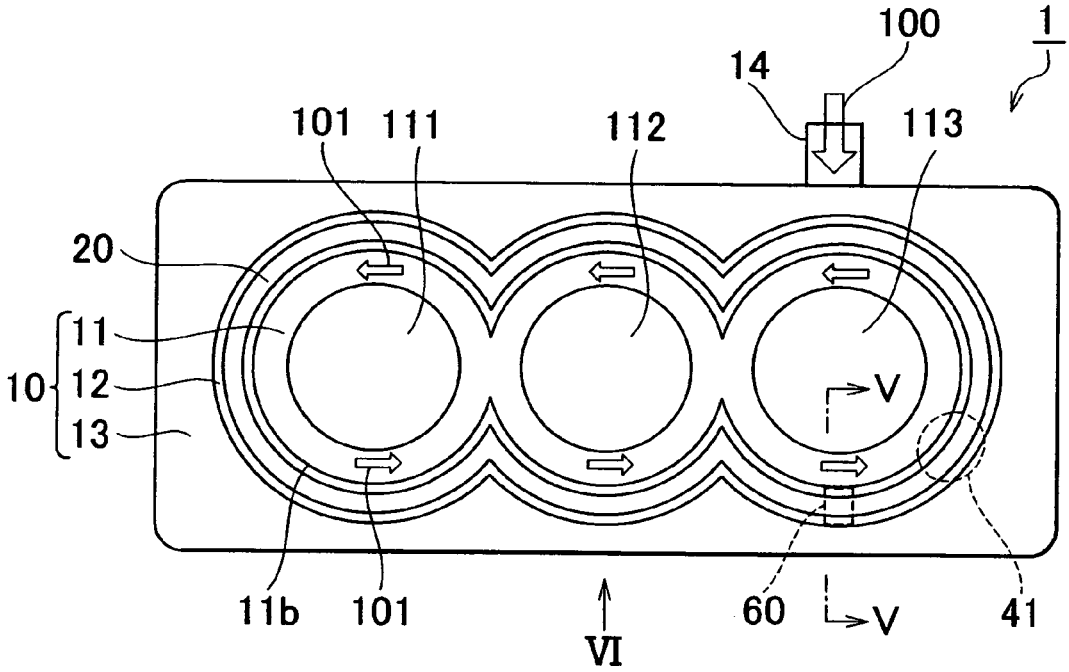
FIG. 4 is a plan view showing a cooling structure of a cylinder block according to a third embodiment of the invention.
Figure 5:
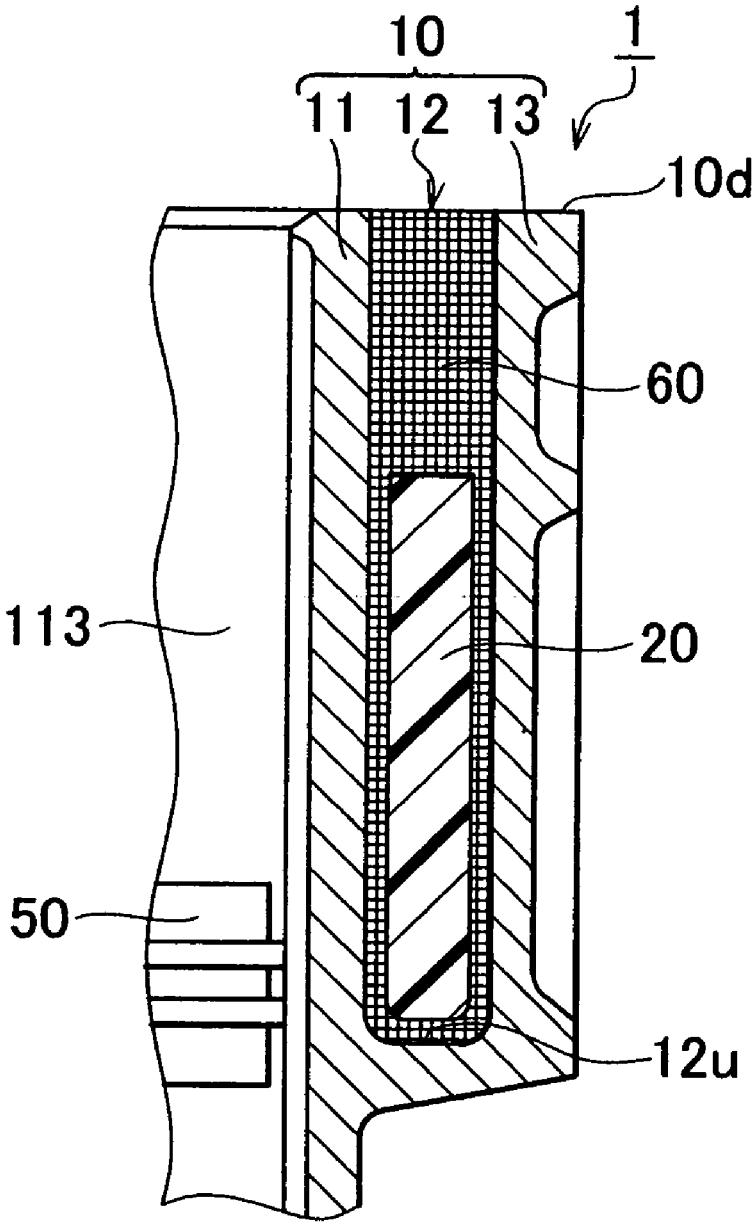
FIG. 5 is a cross sectional view taken along line V—V in FIG. 4.
Figure 6:
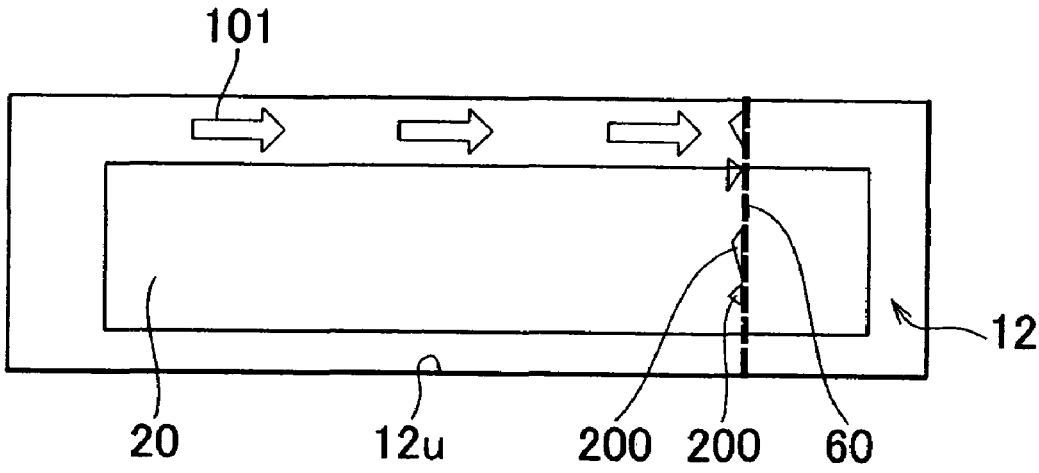
FIG. 6 is a lateral view showing the water jacket portion seen in a direction indicated by an arrow VI in FIG. 4.

FIG. 4 is a plan view showing a cooling structure of a cylinder according to a third embodiment of the invention. FIG. 5 is a cross sectional view taken along line V—V in FIG. 4. FIG. 6 is a lateral view showing a water jacket portion seen in a direction indicated by an arrow VI in FIG. 4. As shown in FIG. 4, the cooling structure 1 of a cylinder block according to the third embodiment of the invention includes the bore wall 11*b*, the water jacket portion 12 which is provided so as to surround the entire outer periphery of the bore wall 11*b*, and the water jacket spacer 20 which is inserted in the water jacket portion 12. As shown in FIG. 5 and FIG. 6, the cooling structure 1 of a cylinder block according to the third embodiment of the invention further includes a filter 60 which is fitted to the water jacket spacer 20, and which serves as the foreign matter collecting mechanism. The filter 60 is a mesh filter, as shown in FIG. 5. The filter 60 filters out the foreign matter 200 in the coolant. Since the filter 60 is fitted to the water jacket spacer 20, the water jacket spacer 20 has a function of capturing foreign matter, and filters out the foreign matter 200 flowing in the coolant, together with the burr that has been cut off and has been caused to fall by the water jacket spacer 20. As shown in FIG. 5, a piston 50 is housed in the bore region 113, and the piston 50 is reciprocated in the bore region 113.

In the first and second embodiments of the invention, since the foreign matter collecting mechanism is provided in the bottom portion 12*u* of the water jacket portion 12, the burr that occurs when the water jacket spacer 20 is installed and sand that is used during casting are collected. However, in the third embodiment, the filter 60 is fitted not only to the bottom portion 12*u*, but also to other portions of the water jacket spacer 20. Thus, the filter 60 for collecting foreign matter in the cooling system, which is not conventionally used, is fitted to the water jacket spacer 20. Therefore, efficiency of collecting foreign matter is improved without increasing the number of components, and without reducing installability of the water jacket spacer 20.

The filter 60 extends from a deck surface 10*d* to the bottom portion 12*u*. The filter 60 surrounds the water jacket spacer 20, and positions the water jacket spacer 20. The coolant can pass through the filter 60. However, the foreign matter 200 cannot pass through the filter 60 as shown in FIG. 6. Thus, the foreign matter 200 is captured by the filter 60. In this embodiment of the invention, only one filter 60 is provided. However, the number of the filters 60 is not limited to one, and the filter 60 may be provided in plurality. Also, the filter 60 may be provided on the upstream side (hole 14 side), or the downstream side (gasket hole 41 side).

The filter 60 may be replaced by a porous material through which fluid passes through. Also, the filter 60 may be replaced by other meshed materials.

The structure of the filter 60 is not limited to a specific structure, and the filter 60 may have any structure as long as the filter 60 does not stem the flow of the coolant, and filters out the foreign matter 200. Also, the filter 60 may be made of various materials such as inorganic matter, organic matter, and resin.

The cooling structure of a cylinder block that is thus configured according to the third embodiment of the invention produces the same effects as the effects of the cooling structure of a cylinder block according to the first embodiment.

Figure 7:
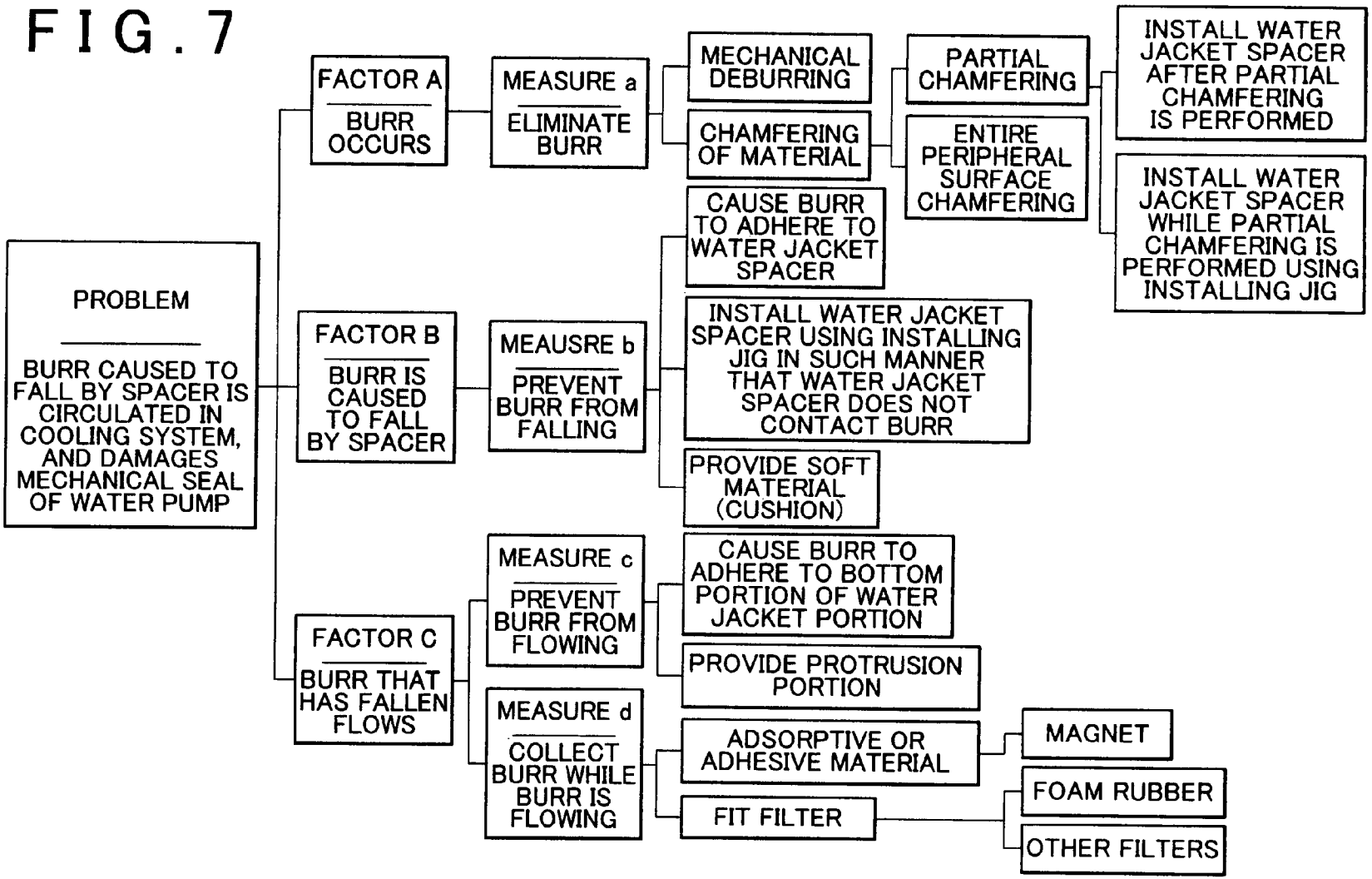
FIG. 7 is a diagram explaining a principle of solving a problem in a cooling structure of a cylinder block according to a fourth embodiment of the invention.

FIG. 7 is a diagram explaining a principle of solving the problem in a cooling structure of a cylinder block according to a fourth embodiment of the invention. It is an object of the invention to remove the burr that is cut off and is caused to fall by the water jacket spacer. That is, it is an object of the invention to solve the problem that the burr may be circulated in the cooling system, and may damage the mechanical seal of the water pump. Factors causing the problem include factors A to C shown in FIG. 7. The factor A is that the burr occurs. The factor B is that the burr is caused to fall by the water jacket spacer. The factor C is that the burr that has fallen flows. The problem is solved by taking a measure against one of the factors A to C.

First, as the measure "a" against the factor A, it is conceivable to eliminate the burr. In order to eliminate the burr, it is conceivable to perform mechanical deburring and chamfering of material. Since the shape of the upper surface of the cylinder block is complicated, the mechanical deburring is difficult. Therefore, in general, the chamfering of material is employed. The chamfering includes partial chamfering and entire peripheral surface chamfering. The partial chamfering is chamfering performed on only one portion. The entire peripheral surface chamfering is chamfering performed on an entire peripheral surface of each of all regions where the burr occurs. Methods of the partial chamfering include a method in which the water jacket spacer is installed after the partial chamfering is performed, and a method in which the water jacket spacer is installed while the partial chamfering is performed using an installing jig.

As a measure against the factor B, it is conceivable to prevent the burr from falling as shown in a measure "b". Methods of preventing the burr from falling include a method in which the burr is caused to adhere to the water jacket spacer, a method in which the water jacket spacer is installed using an installing jig in such a manner that the water jacket spacer does not contact the burr, and a method in which a soft material is provided on a surface of the water jacket spacer so that the soft material serves as a cushion.

Measures against the factor C include a measure "c" in which the burr is prevented from flowing, and a measure "d" in which the burr is collected while the burr is flowing. The measure "c" includes a method in which the burr is caused to adhere to the bottom portion of the water jacket portion, and a method in which a protrusion portion is provided in the bottom portion of the water jacket spacer. The measure "d" includes a method in which an adsorptive material or an adhesive material is used, and a method in which a filter is provided. As the method in which an adsorptive material or an adhesive material is used, it is possible to employ a method in which a magnet is used.

The method in which a magnet is used is effective particularly when foreign matter composed of iron alloy is collected. More specifically, as a method in which the burr is collected in the cylinder block 10 made of cast iron, it is possible to employ the method in which a magnet is used. Also, the method in which a filter is used includes a method in which a porous material such as foam rubber is used, and a method in which other filters are used. Not only the foam rubber but also a porous metal material or the like may be used as a filter.

In each of the first to third embodiments, the cylinder block 10 includes the cylinder liner assembly 11 which is provided inside the cylinder block 10; the water jacket portion 12 which is provided so as to surround the cylinder liner assembly 11, and which serves as the cooling medium passage; and the cylinder block base portion 13 which surrounds the water jacket portion 12, and which is opposed to the cylinder liner assembly 11.

The cylinder liner assembly 11 is constituted by a cylinder liner that is made of iron; and aluminum alloy that surrounds the cylinder liner. The cylinder liner assembly 11 includes bore regions 111, 112, and 113 in each of which a piston is inserted. Each of the bore regions 111, 112, and 113 is a substantially cylindrical region. The plural bore regions 111, 112, and 113 are arranged in one direction.

In each of the first to third embodiments, the three bore regions 111, 112, and 113 are provided. However, the number of the bore regions is not limited to three. The number of the bore regions 111, 112, and 113 may be variously changed. The cylinder liner assembly 11 includes the bore wall 11*b*. The bore wall 11*b* is cooled by the cooling medium (coolant) supplied to the water jacket portion 12. Heat generated in the bore regions 111, 112, and 113 is dissipated from the bore wall 11*b* to the outside.

The water jacket portion 12 is provided between the cylinder liner assembly 11 and the cylinder block base portion 13. The water jacket portion 12 serves as the passage through which the coolant flows. The water jacket portion 12 includes the bottom portion 12*u*. The cylinder liner assembly 11 is connected to the cylinder block base portion 13 at the bottom portion 12*u* of the water jacket portion 12. The water jacket portion 12 is configured to have a substantially uniform width. That is, a distance between the bore wall 11*b* of the cylinder liner assembly 11 and the cylinder block base portion 13 is substantially uniform.

Further, as the cooling medium, various fluids such as water, long-life coolant, and oil can be used.

Each of the bore regions 111, 112, and 113 is a hollow cylindrical region. The piston is provided, and is reciprocated in each of the bore regions 111, 112, and 113. Accordingly, cylinders in the bore regions 111, 112, and 113 extend in parallel with each other, that is, axes of the cylinders in the bore regions 111, 112, and 113 extend in parallel with each other.

The embodiments of the invention have been described. However, various modifications can be made to the aforementioned embodiments. The invention can be applied to a gasoline engine and a diesel engine. Also, the engine to which the invention is applied may have a single cylinder, or plural cylinders. Also, the invention can be applied to various engines such as an in-line engine, a V-type engine, a W-type engine, and a horizontal opposed engine.

Thus, the embodiments of the invention that have been disclosed in the specification are to be considered in all respects as illustrative and not restrictive. The technical scope of the invention is defined by claims, and all changes which come within the meaning and range of equivalency of the claims are therefore intended to be embraced therein.

What is claimed is:

1. A cooling structure of a cylinder block, comprising:

a water jacket portion which is provided so as to surround an entire outer periphery of a bore wall;

a water jacket spacer which is inserted in the water jacket portion; and a foreign matter collecting mechanism which is provided in a bottom portion of the water jacket portion, and which collects foreign matter.

2. The cooling structure of a cylinder block according to claim 1, wherein the foreign matter collecting mechanism is a protrusion portion which is provided in the bottom portion of the water jacket portion.

3. The cooling structure of a cylinder block according to claim 1, wherein the foreign matter collecting mechanism is an adhesive material which is provided in the bottom portion of the water jacket portion.

4. The cooling structure of a cylinder block according to claim 1, wherein the foreign matter collecting mechanism is a magnet which is provided in the bottom portion of the water jacket portion.

5. A cooling structure of a cylinder block, comprising:

a water jacket portion which is provided so as to surround an entire outer periphery of a bore wall;

a water jacket spacer which is inserted in the water jacket portion; and a foreign matter collecting mechanism which is fitted to the water jacket spacer, and which collects foreign matter.

6. The cooling structure of a cylinder block according to claim 5, wherein the foreign matter collecting mechanism is a filter which is fitted to the water jacket spacer.

7. The cooling structure of a cylinder block according to claim 6, wherein the filter is foam rubber.

8. The cooling structure of a cylinder block according to claim 6, wherein the filter is a porous metal material.

* * * * *